United States Patent [19]

Kezer

[11] 4,291,629

[45] Sep. 29, 1981

[54] COMBINED T-SHAPE SMOKE PROJECTILE AND LAUNCHING ASSEMBLY

[75] Inventor: Osman F. Kezer, Fredericksburg, Va.

[73] Assignee: The United States of America as represented by the Secretary of the Army, Washington, D.C.

[21] Appl. No.: 91,863

[22] Filed: Nov. 6, 1979

Related U.S. Application Data

[63] Continuation-in-part of Ser. No. 895,177, Apr. 10, 1978, abandoned.

[51] Int. Cl.[3] ..... F42B 13/44

[52] U.S. Cl. ..... 102/334; 102/364; 102/513

[58] Field of Search ..... 102/5, 6, 34.4, 37.6, 102/35.6, 60, 61, 65, 66, 87, 90; 89/1 F

[56] References Cited

U.S. PATENT DOCUMENTS

| | | | |
|---|---|---|---|
| 1,890,589 | 12/1932 | Reynolds | 102/90 X |
| 2,079,008 | 5/1937 | Goss | 102/65 |
| 2,094,562 | 9/1937 | Lowy | 102/65 |
| 3,402,665 | 9/1968 | Tarpley, Jr. et al. | 102/90 X |
| 3,416,401 | 12/1968 | Goldbeck et al. | 102/65 |
| 3,439,610 | 4/1969 | Myers | 102/61 X |
| 3,714,899 | 2/1973 | Flippi | 102/90 |
| 4,069,762 | 1/1978 | Maury | 102/90 |

FOREIGN PATENT DOCUMENTS

| | | | |
|---|---|---|---|
| 1169806 | 5/1964 | Fed. Rep. of Germany | 89/1 F |

*Primary Examiner*—Harold J. Tudor

*Attorney, Agent, or Firm*—Nathan Edelberg; Robert P. Gibson

[57] ABSTRACT

A T-shaped combined smoke-producing projectile and launch housing assembly having dual-canister means for establishing an effective smoke screen simultaneously with an effective source of illumination and light-radiation throughout the duration of projectile flight after initiation of the launch or propelling charge. The aforesaid assembly is adapted to be attached to and detached from a tank or other vehicle within about 30 seconds via suitable quick release mounting means not comprising a part of this invention. The assembly includes a launching or propelling charge disposed within a propelling charge chamber, and means for causing simultaneous ignition of the compounds within the dual smoke generating canisters and of intense light-radiation to help blind enemy automatic weapons systems after the projectile has been launched.

9 Claims, 4 Drawing Figures

10
12
14, 15
16
18
19
20
21
22
23
24
25
26
28
30
34
36
38
40, 42
44
46
48
50
52
54
56
58
60
60b
60c
62
64
66
67
68
70
72

COMBINED T-SHAPE SMOKE PROJECTILE AND LAUNCHING ASSEMBLY

DEDICATORY CLAUSE

The invention described herein may be manufactured, used, and licensed by or for the Government for governmental purposes without the payment to me of any royalties thereon.

BACKGROUND AND OBJECTS OF THE INVENTION

This application is a continuation-in-part of my parent application Ser. No. 895,177, now abandon filed Apr. 10, 1978, intended to become abandoned.

This invention relates to the field of smoke screen generating devices primarily intended to provide smoke and other cover for a combat vehicle for any maneuver in which the vehicle may be participating. Previous smoke-producing grenades intended to provide a quick "getaway" for combat vehicles have been found to be inadequate for screening purposes, due to the excessive time required for the grenade to produce the desired volume of smoke, as well as due to the relatively short life of solely smoke blinding characteristics.

A principal objective of my invention is to provide a smoke-producing projectile which establishes an effective smoke screen simultaneously with an effective flare source of illumination or selected light band radiation throughout the duration of projectile flight after initiation of the propelling charge. The flare source serves to overload the electro-optical portion of an enemy's automatic weapons systems to preclude or significantly deter the ability of that weapons system to retarget on the vehicle or vehicles in the area of the one launching the smoke grenade.

Another objective of my invention is to provide a smoke-producing projectile in which the means to detonate the propellant charge is accomplished by remote control firing switch located within the safe confines of the combat or other host vehicle.

Still another objective of my invention is to provide a smoke-producing projectile in which the means to initiate smoke generation and intense light radiation is accomplished as a result of detonating the propellant charge without requiring a separate independent ignition system.

Other objectives and advantages of the present invention will become more apparent from the following more detailed description taken in conjunction with the accompanying illustrative drawings.

BRIEF SUMMARY OF THE INVENTION

The present invention is used to provide very rapid obscuration via an effective smoke screen upon launching the smoke-producing projectile or grenade from a combat vehicle through a flat trajectory until the smoke projectile falls to rest some distance away from the vehicle. Remote control firing from within the vehicle ignites a propelling charge which launches the smoke projectile with a spin rate of one projectile turn about the axis of the launch piston for every approximate thirty feet of linear distance traveled launching gases produced are also utilized to cause ignition of the smoke generator compounds and of an attached illuminating flare. This combined projectile flare and smoke generator effectively provides a smoke cover for a combat vehicle during any maneuver in which the vehicle is participating. The projectile or grenade embodies a cylindrical container comprising interconnected canisters filled with red phosphorous. An apertured piston has an end which is screwed into the side of the container half-way between the ends. The piston fits in a piston housing or cylinder that is attached to a bracket on the fender or other suitable portion of a tank. A propellant charge, on ignition, drives the piston out of the housing thus launching the grenade. The propellant also ignites a rocket propellant block or wafer which produces high temperture gases that vaporize the red phosphorous smoke agent. These gases carry the vaporized material though orifices located at the exposed ends of the cylinders into the atmosphere at a flow velocity approaching the speed of sound. This vaporized material produces a copious white cloud during the flight of the grenade through the air.

This invention may be better understood from the following detailed description taken in conjunction with the accompanying illustrative drawings showing one or more preferred embodiments of the invention.

DETAILED DESCRIPTION OF THE PREFERRED EMBODIMENT

Figures 1, 2:
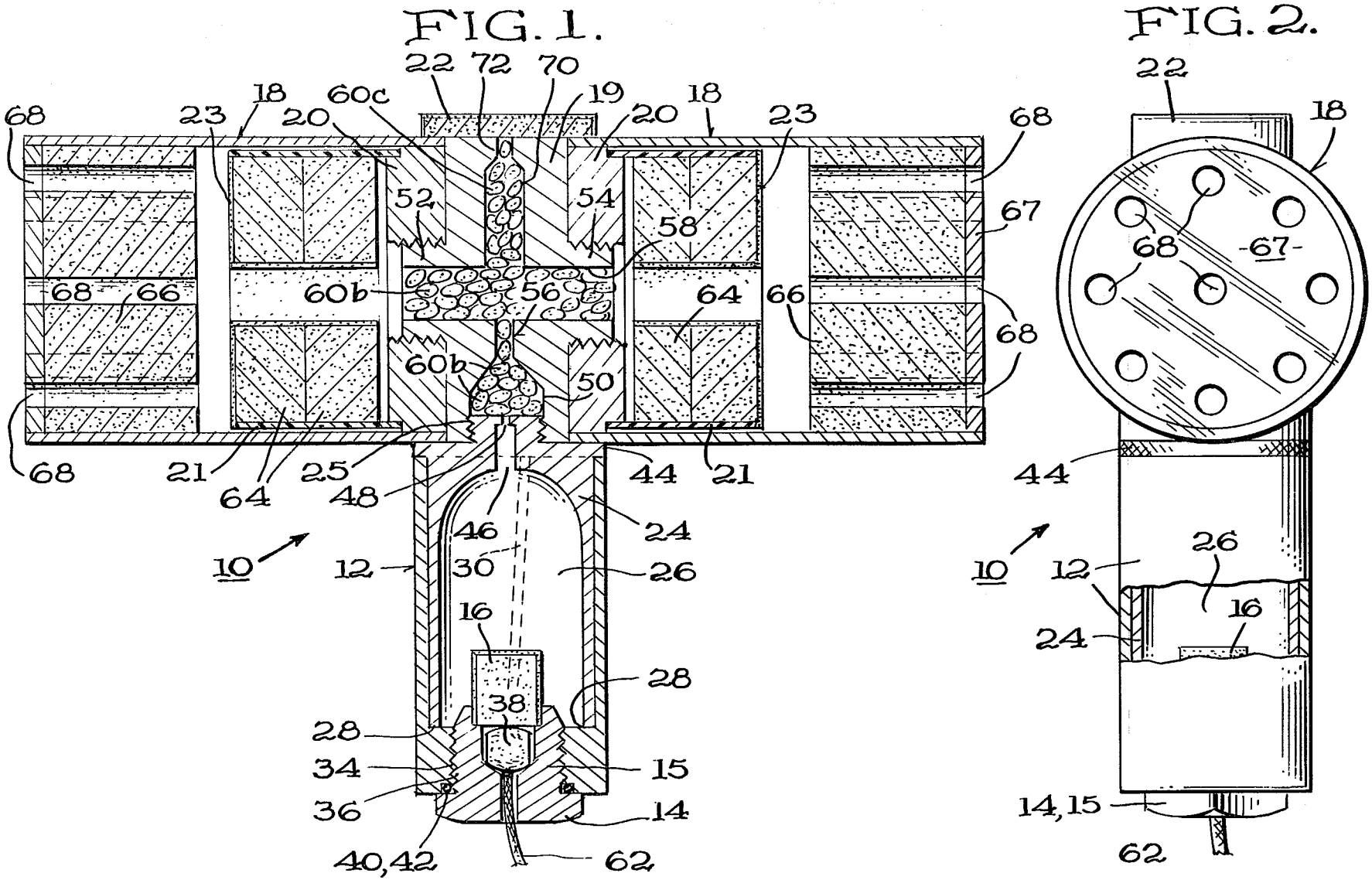
FIG. 1 is a cross-sectional view of the smoke-producing projectile and launching tube assembly.
FIG. 2 is an elevational end view of the assembly of FIG. 1, having the same appearance from both ends.
Figure 3:
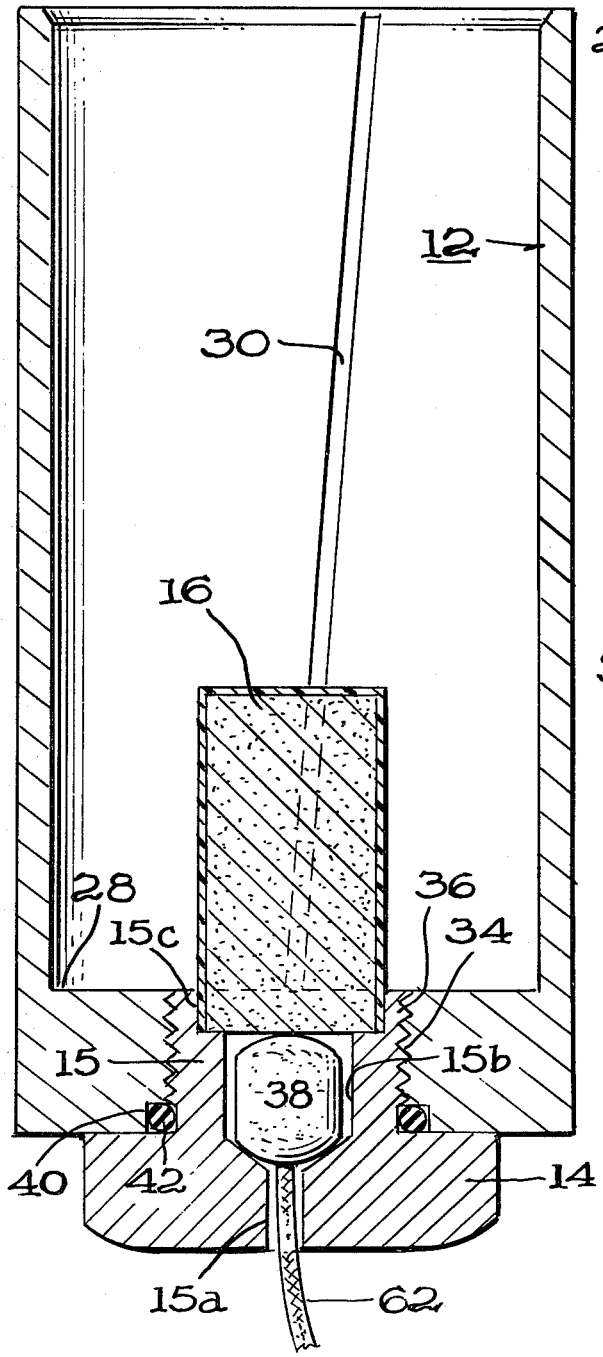
FIG. 3 is an enlarged cross sectional view of the launching or propelling charge housing and igniter assembly.

As shown in FIG. 1, the assembly comprises a smoke-producing projectile 10 and a propelling charge chamber or housing 12 of cylindrical form for receiving an igniter assembly 14 and a propelling charge 16. The projectile further includes two smoke-producing canisters 18, 18 interconnected near their respective base end plates 20, 20 by a center coupling 19, and further includes a flare 22 not only for generating illumintion, but also serves to overload or "blind" enemy electro-optical systems to deter and/or preclude their ability to retarget the subject vehicle. A cylindrical piston 24 is slidably disposed concentrically within the housing 12 and has one end formed with an externally threaded boss 25 for complemental attachment to the coupling member 19, and has the other end formed with a large propelling-charge-chamber 26. The piston 24 is slid down into the housing until its annular shoulder abuts the interior end of the housing 12 at 28. At least a pair of internal rifling grooves (FIG. 2) are formed in housing 12 for engagement with piston-attached pins 32, (FIG. 3). The pin and groove engagement impart a predetermined rotation to the smoke projectile during its passage along and out of the housing such that the projectile 10 will be rotating at a rate of one complete turn for every thirty feet of linear distance traveled. An internally threaded boss 34 is provided at one end of the housing 12 and the igniter assembly 14 is mounted in this boss. The igniter assembly 14 extends through the boss 34 with the free end of charge 16 projecting freely and centrally into the propelling charge chamber 26. This assembly 14, more clearly seen in FIG. 2, includes a preferably hex-headed screw plug body 15 having a small center bore 15*a* at the outer end, and intermediate counterbore 15*b*, and an innermost counterbore 15*c*. The male threads 36 of plug body 15 mate with those of the internally threaded boss 34. The assembly 14 further includes a squib 38 within the counterbore 15*b*. Squib 38 is in direct contact with an inner end of the cylindrically shaped propelling charge 16. Charge 16 is retained and positioned centrally within the counterbore 15*c* (FIG. 2). An O-ring 42 and suitable adhesive are preferably used in recess 40 for sealing the igniter assembly 14 to the housing.

Figure 4:
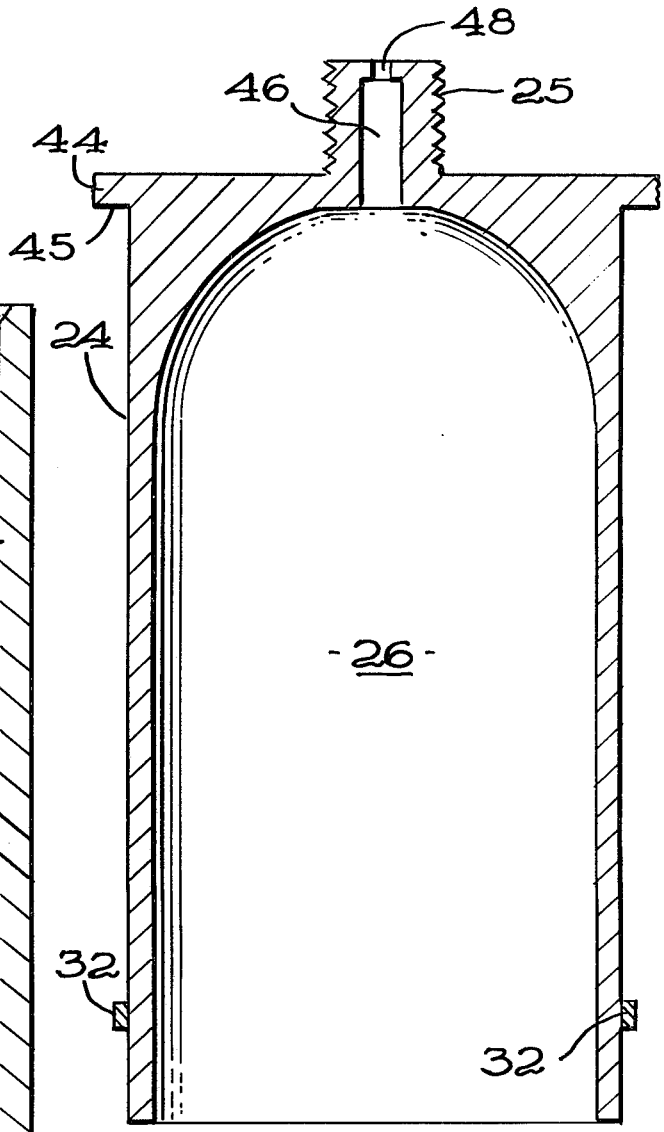
FIG. 4 is a corresponding enlarged cross-sectional view of the propelling piston.

Piston 24 may be provided at its upper end with a knurled or hex collar 44 having an adjacent abutting surface 45 to mate and seat upon the outer end of the propelling chamber 12. The threaded boss 25 of piston 24 is provided with a cylindrical center bore or passageway 46 (FIG. 4), and a coaxial smaller bore orifice 48 to provide communication for burning gases exiting from the propelling charge chamber 26 into the interior of coupling 19. The coupling 19 is mounted via an internally threaded bore 50 upon the boss 25. Bore 50 is reduced in diameter beyond the threaded portion and provides a chamber in which several ignition pellets 60*a* are housed, to be further described hereinafter. Coupling 19 further embodies two laterally extending threaded bosses 52, 54 to provide for screw-thread-mounting of preferably only two smoke-generating canisters 18, 18 at right angles to the axis of the launch tube 12 and piston 24.

Canisters 18, 18 are identical, and are of a known but preferably slightly scaled-down cylindrical construction for housing the gas-generating and smoke-generating compounds. Thus, they do not constitute any specifically novel sub-assemblies per se of the otherwise overall novel T-shape grenade and launch assembly.

Continuing the description of coupling member 19, it comprises a body which is provided with a reduced center bore passageway or orifice 56, preferably coaxially with and as a communicative extension of the aforesaid reduced bore 50. It is also coaxial with the aforesaid orifice 48. The orifice/passageway 56 terminates in a cylindrical transversely oriented, generally horizontal chamber 58, and said passageway 56 provides communication for burning ignition gases between the orifice 48 and the chamber 58. A plurality of conventional ignition pellets 60 repose within the horizontal chamber 58.

In operation, ignition is started in a known manner by causing the bridge wire (not shown) in squib 38 to ignite by application of electrical current conducted through wires 62. The igniting bridge wire then causes a small conventional base charge (not shown) contained in squib 38 to ignite. Squib ignition in turn ignites propelling charge 16 causing the charge to burn rapidly and generate hot gases which build the pressure in chamber 26 up to a level that causes a propulsive force to be imparted to the interior of the piston 24. The propulsive force causes the piston 24, coupling 19 and the dual smoke canisters 18, 18, all collectively assembled in a "T" configuration smoke projectile, to propellingly separate via rifling grooves 30 from the fixedly mounted sleeve housing 12. Some of the hot gases generated in chamber 26, in addition to providing the propulsive force, are directed through passageway 46, orifice 48, inward portion of bore 50 where they cause ignition first of the ignition pellets 60*a* therein, whereby the further generated hot gases continue the fire line into passageway 56 to impinge upon the greater volume of ignition pellets 60*b* in chamber 58. The hot gases ignite the pellets causing them to burn rapidly and generate additional hot gases. Pressure in chamber 58 is quickly built up to a level that causes flow of these hot gases into both smoke-generating canisters 18, 18 because orifice 48 restricts back flow of the newly generated gases back into chamber 26. Flow of hot gases into the canisters causes ignition of gas generators 64 and smoke agent 66. The generated smoke is expelled by gas pressure through a plurality of exit orifices 68 located in each end of the two smoke canisters, as explained in with the BRIEF SUMMARY OF THE INVENTION, supra.

As illustrated, the canisters 18 each include a cylindrical side wall and circular end wall plates. The respective base end walls or plates 20 each have a center aperture with threads to mount the canister on the threaded boses 52, 54. The other or opposite end plate 67 is perforated and will be discussed further hereinafter. The gas generating compounds 64 are covered exteriorly with a suitable inhibitor such as a thin layer of fiberglass 21. The compound material 64 is provided with a center aperture for coaxial alignment with body passageway 58 of the coupling 19. The center aperture is also suitably coated with an inhibitor material, such as lacquer or paint. The outermost end of the gas-generating compound is preferably covered at 23 with a fire mix material to help initiate combustion from that end. The smoke-producing agent or phosphorous material 66 is in a customary compressed cake form and is mounted in the outermost end of each canister adjacent its end wall plate or disc 67. The smoke-producing agent 66 and end disc 67 are provided with the aforementioned plurality of exit orifices 68.

The illuminating and electro-optical-blinding flare 22 is also ignited essentially simultaneously either by a suitable electronic means (as by a separate squib means not shown, but essentially the same as squib means 38 above), or by a continuation of the launch fire train means. Relative to the latter mode which is illustrated in FIG. 1, the center coupling 19 is provided with a further bore 70 communicatively extending beyond chamber 58 in a preferably coaxial manner with bores 56 and 48. Bore 70, which is also filled with some of the same type ignition pellets 60*c*, reduces down to an orifice 72 adjacently beneath and communicatively with the mounted flare material 22.

The smoke projectiles are generally launchable with the T-shape horizontal at approximately 10'–12' above the ground at a slight incline so as to assure clearance of other vehicles in the area and to achieve the desired distance. Because of the initial horizontal T-configuration, the projectile tends to "fly" and also the rifling slots impart a slow rotative spin about the axis of the piston 24 of one 360° rotation preferably for every approximate thirty to fifty linear feet traveled. The spin rate can be controlled by the inclination of the premachine rifling slots. The purposefully slow rotation enables the device to take advantage of natural air convection and cooling during the smoke-particle-growth; also, because the low altitude, and rotative character much of the gas-generated energy is dissipated against the ground surface, thus preventing poor protection from undue pillaring of the smoke cloud.

The T-shape configuration is necessary to provide the requisite aerodynamic shape and drag to enable the grenade to "fly" satisfactorily and provide an axis for the desired/requisite rotation. Each of the burning smoke-generating canisters is in effect a small rocket motor imparting alternating periodic lift during the aforedescribed slight rotation. After or during the basic flight, if the projectile/grenade prematurely hits the ground, the force of the small rocket motors continue to cause the grenade to "walk" or "skip" along the ground and to continue to dispense the smoke screening vapor to provide the vehicle-obscuring cloud formations.

Utilization of three or four canisters disposed in a Y- or X-formation on the piston, instead of the preferred dual disposed T-relationship, might be contemplated and deemed also to be operational. However, use of four such canisters is not as desirable because the additional two canisters would double the potential "rocket motor" reactive thrust when the energy generating therefrom collectively impinges upon the earth's surface. This tends to impart or generate undesirable additional lift to the projectile grenade, which added elevation during the flight trajectory would be self-defeating by causing formation of the screening cloud too high relative to the subject vehicles.

The propulsive force generated from the preferred dual canister form described above is of sufficient magnitude to provide deployment of the smoke projectile within a relatively flat trajectory. Coincident with the deployment, there is a continuous generation of both the smoke and illumination throughout the distance traveled by the projectile on its trajectory from the combat vehicle until it finally comes to rest. The heat generated as a by-product of the smoke also forms a large heat or thermal cloud to help defeat some wave lengths of enemy automatic weapons systems. Because the thermal cloud is relatively short lived, the light radiation flare feature provides an additional substantial "blinding" factor to continue to help overload the electro-optical systems of enemy automatic weapon systems.

While the heretofore described smoke projectile exemplifies preferred embodiments, it is to be understood that the invention is not confined to the precise details of construction herein set forth by way of illustration. It is thus apparent that many changes and variations may be made therein, by those skilled in the art, without departing from the spirit of the invention or without exceeding the scope of the appended claims.

What is claimed is:

1. A multi-canister type projectile and related propelling charge housing assembly of T-shape configuration for providing a smoke screen from the projectile upon deployment exteriorly from a combat vehicle, said assembly comprising in combination:

(a) a propellant charge housing of cylindrical sleeve form having one open end and an opposite end wall with a central threaded aperture;

(b) an igniter assembly and means for removably mounting same in and closing off the end of said housing end wall opposite its open sleeve end portion;

(c) a projectile-propelling charge disposed within said housing and in operative ignitable contact with said igniter assembly;

(d) an open-skirted piston disposed for complemental slidable movement within the open-ended sleeve of said housing with said piston having a step-down center bore passageway in a threaded portion at an end opposite the open skirted portion;

(e) a pair of ignitable smoke-generating canister sub-assemblies mounted in axial alignment, and connectable with said piston, each sub-assembly comprising predetermined amounts of smoke and gas-generating compounds;

(f) mounting means for interjoining said canisters sub-assemblies in said axial alignment, said mounting means having in one side thereof a threaded portion for complemental attachment with said threaded portion of said piston so as to form a T-shape projectile whereby an axis through said aligned canisters is transverse to an axis through the center of said piston; and (g) said mounting means having intercommunicating axial and radial passageways, ignition pellet means disposed within said axial passageway, and said radial passageway being in operative communication with the center bore of said piston, whereby ignition of said igniter assembly will effect both deployment of said projectile and ignition of said gas and smoke-generating compounds via said ignition pellet means.

2. The assembly is defined in claim 1, further including high density light-ray-producing flare means attached to said mounting means, and having means operatively connecting said flare means with an ignition source for essentially simultaneous ignition of the flare means along with the ignition of said gas-and-smoke-generating compounds.

3. The assembly as defined in claim 1, wherein said mounting means includes a center hub coupling member having a pair of axially opposed external boss members provided with male threads adapted to mate with corresponding female threads respectively provided on said smoke generating canister subassemblies.

4. The assembly as defined in claim 2, wherein said mounting means includes a center hub coupling member having a pair of axially opposed external boss members provided with male threads adapted to mate with corresponding female threads provided on said smoke-generating canister sub-assemblies.

5. The assembly as defined in claim 1, wherein said housing and said piston have complementally coacting rifling means to effect a predetermined in-flight rotation of the projectile.

6. A T-shaped assembly of a smoke-producing projectile and a launch/propelling charge housing, adaptable for exterior mounting upon combat vehicles or the like, said assembly comprising in combination:

(a) a projectile comprising at least a pair of cylindrical smoke-generating canisters having mounting means to operatively interconnect same in an axially aligned manner; each canister having therein predetermined amounts of gas and smoke producing compounds;

(b) said mounting means for interconnecting said pair of smoke-generating canisters including a body having an axially disposed passageway with ignition pellets housed therein, said passageway being in operative communication with a corresponding axial passageway in each of said canisters;

(c) said mounting means further having a radially transverse passageway with a female threaded initial entry portion and an area to house ignition pellets therein, said passageway changing in size to a reduced diameter portion interjoining and communicating with a medial portion of the axially disposed passageway in said mounting means;

(d) a cylindrical sleeve member constituting a launching tube and propelling-charge-housing, said sleeve member having an open outer end and a closed base end, whereby said sleeve member is adapted to be removably affixed to the exterior of said vehicle;

(e) an igniter assembly with means for removably mounting same through the closed base end of said launching tube, said igniter assembly including a projectile-propelling charge projecting into a hollow portion of said launching tube;

(f) said projectile further comprising a hollow cylindrical piston having a transverse wall at one end with means thereon adapted for connecting same unitarily with the aforesaid mounting means which interjoin said canisters, said piston and canisters forming a T-shaped projectile.

(g) said piston being of a diameter to slidably fit within said propelling charge housing, and said piston having at an opposite end an enlarged open ended cylindrical chamber adapted to receive an explosive force of a propelling charge upon ignition thereof;

(h) said cylindrical piston having at its end axially opposite the aforesaid cylindrical chamber an annular shoulder and a axially extended male boss having threads for complementally mating with the female threads of said mounting means; and (i) said cylindrical piston having a reduced central passageway of substantially smaller diameter than and openly connected with but extending axially away from said enlarged open ended cylindrical chamber; and said reduced cylindrical passageway terminating in a further reduced orifice adjacent to and for communicating with the radially transverse passageway of said mounting means.

7. The assembly as defined in claim 6, further including high density light-ray-producing flare means attached to said canister-mounting means, and having means operatively connecting said flare means with an ignition source and for essentially simultaneous ignition of the flare means along with the ignition of said smoke-generating canisters.

8. The assembly as defined in claim 7, wherein said means operatively connecting said flare means with an ignition source inclue a plurality of ignition pellets disposed in a further passageway formed in said canister-mounting means, said further passageway being in fire-line communication with the axially disposed passageway in said canister-mounting means and with said flare means.

9. The assembly as defined in claim 6 wherein said launch tube sleeve member and said piston have complementally coacting rifling groove and pin means for effecting a predetermined in-flight rotation of the projectile.

* * * * *